US009134000B2

(12) United States Patent
de Lamberterie et al.

(10) Patent No.: US 9,134,000 B2
(45) Date of Patent: Sep. 15, 2015

(54) ILLUMINATING MODULE FOR A MOTOR VEHICLE

(71) Applicant: Valeo Vision, Bobigny Cedex (FR)

(72) Inventors: Antoine de Lamberterie, Paris (FR); Ziyed Thabet, Paris (FR)

(73) Assignee: Valeo Vision, Bobigny (FR)

( * ) Notice: Subject to any disclaimer, the term of this patent is extended or adjusted under 35 U.S.C. 154(b) by 78 days.

(21) Appl. No.: 14/026,114

(22) Filed: Sep. 13, 2013

(65) Prior Publication Data

US 2014/0078768 A1 Mar. 20, 2014

(30) Foreign Application Priority Data

Sep. 17, 2012 (FR) ..... 12 58683

(51) Int. Cl.
*F21S 8/10* (2006.01)

(52) U.S. Cl.
CPC ..... *F21S 48/1388* (2013.01); *F21S 48/1159* (2013.01); *F21S 48/1208* (2013.01); *F21S 48/1266* (2013.01); *Y10T 29/49002* (2015.01)

(58) Field of Classification Search
CPC ..... F21S 8/10; F21S 48/1266; F21S 48/1159; F21S 48/1388; F21S 48/1208; Y10T 29/49002
See application file for complete search history.

(56) References Cited

U.S. PATENT DOCUMENTS

| | | | | |
|---|---|---|---|---|
| 7,682,057 | B2 * | 3/2010 | Albou | 362/507 |
| 7,934,861 | B2 | 5/2011 | Albou | |
| 8,585,261 | B2 | 11/2013 | Schug | |
| 2006/0002130 | A1 | 1/2006 | Albou | |
| 2008/0151567 | A1 | 6/2008 | Albou | |
| 2011/0038168 | A1 | 2/2011 | Schug | |

FOREIGN PATENT DOCUMENTS

| | | |
|---|---|---|
| EP | 1610057 | 12/2005 |
| EP | 1881264 | 1/2008 |
| EP | 1936260 | 6/2008 |
| WO | 2009130655 | 10/2009 |

* cited by examiner

*Primary Examiner* — Bao Q Truong
(74) *Attorney, Agent, or Firm* — Jacox, Meckstroth & Jenkins

(57) ABSTRACT

An illuminating module for a motor vehicle lamp able to form a wide light beam containing a cutoff, which module is equipped with optical elements comprising an output lens and a plurality of concave reflectors associated with a deflector having a reflective face intended to deflect light beams generated by light sources located in the concavities of the reflectors. The output lens is a toric lens, and these optical elements are arranged in order to make the light beams generated by said light sources converge on points of focus before these light beams are transmitted through the output lens. The module comprises two reflectors (102, 102') oriented toward each other.

23 Claims, 3 Drawing Sheets

Lux/degree

Lux/degree

Lux/degree

Lux/degree

ILLUMINATING MODULE FOR A MOTOR VEHICLE

CROSS-REFERENCE TO RELATED APPLICATIONS

This application claims priority to French Application No. 1258683 filed Sep. 17, 2012.

BACKGROUND OF THE INVENTION

1. Field of the Invention

The invention relates to an illuminating module for a motor vehicle, especially intended to generate a wide cutoff-containing optical beam from a plurality of light sources.

2. Description of the Related Art

It is known practice to form an illuminating module for a motor vehicle with a plurality of concave reflectors, each comprising a light source in its concavity, in order to combine the light beams obtained from each reflector and form an optical beam.

By way of example, document EP 1 610 057 B1, which is equivalent to U.S. Publication No. 2006/0002130 and U.S. Pat. No. 7,682,057, describes such a module equipped with three reflectors such that the edges of the reflectors are placed one against the other. The beams obtained from these reflectors are then combined in such a way that the luminous flux at the center of the generated beam is produced by a central module, whereas the luminous flux at the edges of the generated beam is produced by two lateral modules.

Moreover, this document also discloses the use of a deflector to deflect the optical beam obtained from a collector in order to block the upper part of the optical beam generated by this module and thus prevent oncoming drivers or drivers in front of the automotive vehicle from being dazzled.

The present invention results from the observation that such a module could be improved. In particular, it would appear that the optical beam generated by such a module contains notable intensity variations, for example between the center and the edges of the beam, which exhibit maxima specific to each light source. Therefore the intensity of the beam does not decrease uniformly from a maximum intensity level at the center of the beam. In addition, it is possible to observe a decrease in brightness in the vicinity of directions corresponding to intersections between the collectors.

In addition, the efficiency of such a module is insufficient to enable a light beam to be generated with a satisfactory intensity using optical resources limited, for example, to two 3 W light-emitting diodes. This is due to the fact that the reflectors are relatively open and do not allow a maximal amount of flux to be collected.

SUMMARY OF THE INVENTION

The present invention aims to solve at least one of these problems. The invention results from an observation specific to the invention, according to which, in order to optimize the transmission efficiency of the optical beam generated by a source, the latter should be placed at the focal point of a convergent reflector in order for the maximum amount of optical radiation emitted by the source to be collected by this reflector and transmitted to an output lens of the module. Specifically, a so-called "convergent" reflector makes the reflected light rays converge, and therefore has a higher efficiency.

For this reason the present invention relates to an Illuminating module for a motor vehicle lamp able to form a wide light beam containing a cutoff. This module comprises optical elements formed by an output lens and by a plurality of concave reflectors associated with a deflector having a reflective face intended to deflect light beams generated by light sources located in the concavities of the reflectors. The lens is a toric lens, and these optical elements are arranged in order to make the light beams generated by the light sources converge on points of focus before these light beams are transmitted through the output lens.

According to the invention, the module comprises two reflectors oriented toward each other.

Such a module has many advantages. In particular it employs reflectors that collect a large part of the optical radiation emitted by the light sources located at their focal points. By concentrating this radiation to a point of focus before transmitting it through the output lens, such a module makes it possible to generate illuminating lights, typically fog lights, with two sources of limited power, for example two light-emitting diodes with powers of 3 W or less.

Moreover, such a module allows a single beam having a particularly satisfactory uniformity to be formed from a plurality of beams. In fact, such a single beam exhibits a uniform decrease in its brightness from a central portion, thereby improving the comfort of the driver and passenger of a vehicle equipped with such a module.

In one embodiment, the illuminating module is characterized in that the points of focus are located on a focal line of the toric lens.

In one embodiment, the illuminating module is characterized in that the deflector follows, partially or totally, the focal line of the lens.

In one embodiment, the reflectors are based on an ellipsoid shape having two focal points, the light source of one reflector being located at a first focal point of this ellipsoid and the point of focus being located at a second focal point of the same ellipsoid.

In one embodiment, the axis of one reflector, passing through the first and second focal points of the ellipsoid on which it is based, forms a non-zero angle with the optical axis of the lens.

In one embodiment, the reflector has a plane of symmetry allowing it to be installed on both sides of a vehicle.

In one embodiment, the total lateral aperture of the optical beam lies between 40 degrees and 100 degrees.

The invention also relates to a method for manufacturing an illuminating module for a motor vehicle lamp, able to form a wide light beam containing a cutoff, which module is equipped with optical elements comprising an output lens and a plurality of concave reflectors associated with a deflector having a reflective face intended to deflect light beams generated by light sources located in the concavities of the reflectors.

According to the invention, the method comprises a step of arranging these optical elements in order to make the light beams generated by the light sources converge on points of focus before these light beams are transmitted through the output lens, in accordance with a module such as defined above.

Other advantages of the invention will become apparent in light of the description of an embodiment of the invention given below by way of nonlimiting illustration and with reference to the appended figures, in which:

BRIEF DESCRIPTION OF THE ACCOMPANYING DRAWINGS

FIG. 1 schematically shows a vertical cross-sectional view of a module produced according to the invention;

FIG. 2 schematically shows a horizontal cross-sectional view of a module produced according to the invention;

FIGS. 3 and 4 schematically show perspective views of the optical elements of a module produced according to the invention;

DETAILED DESCRIPTION OF THE PREFERRED EMBODIMENTS

In the present description, identical elements or elements having similar functions may be referenced with the same reference number in the various figures.

The embodiment of an illuminating module 100 for a motor vehicle lamp according to the invention, i.e. able to form a wide light beam 101 containing a cutoff, is now described with reference to FIGS. 1 and 2. A beam 101 is considered to be a wide beam 101 when it has a total lateral aperture lying between 40 degrees and 100 degrees, or even a half-aperture, with reference to the longitudinal axis of symmetry of the vehicle, lying between 25 degrees and 50 degrees, the aperture (or the half-aperture) being defined for a minimum intensity of about 100 candelas.

Figure 1:
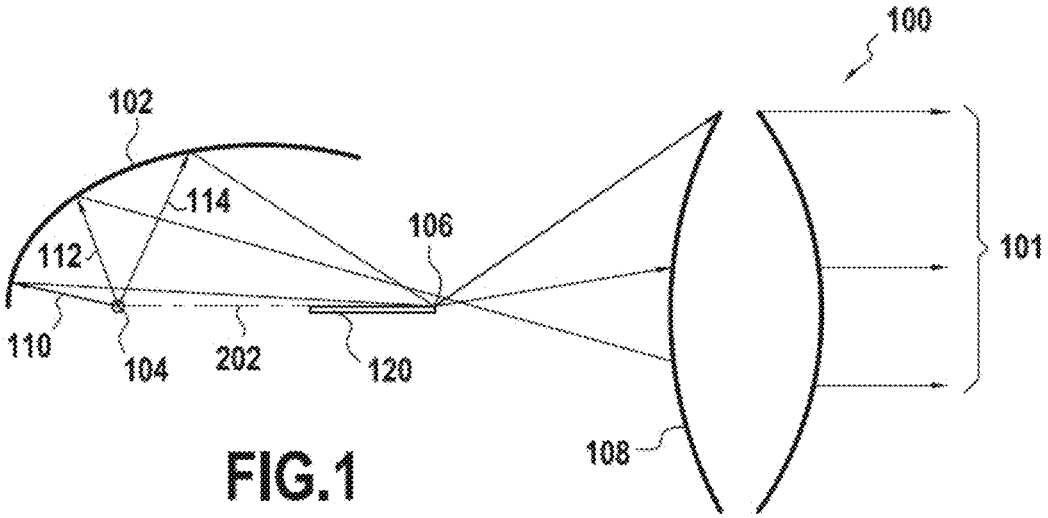
Figure 2:
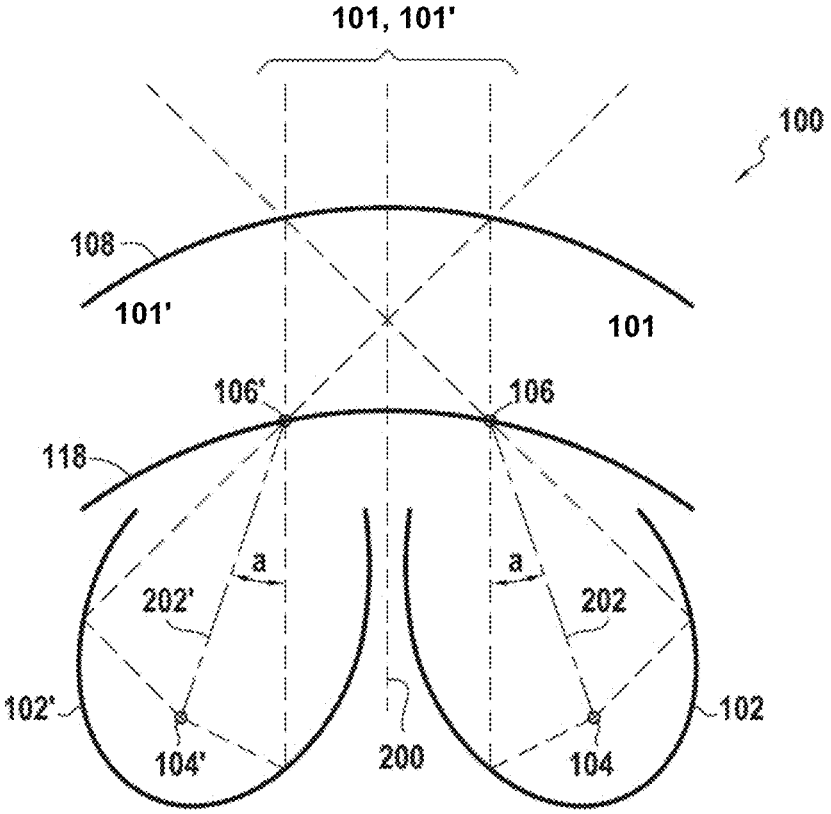

More precisely, FIGS. 1 and 2 show vertical and horizontal cross-sectional views, respectively, of such a module 100, cut through a reflector 102, these sections being cut in vertical and horizontal planes that pass through the source 104 and the point of focus 106 of the light emitted by this source 104 and reflected by the reflector 102. According to the invention, this point of focus 106 is located upstream of an output lens 108 (toric lens) in such a way that the optical beam emitted by the source 104 passes through the lens 108 after having been concentrated at this point of focus 106.

By virtue of such a point of focus 106 located upstream of the lens 108, it is possible to concentrate most of the light emitted by the source 104. By way of example, the optical paths of various rays 110, 112 and 114 emitted by the source 104 are shown travelling from the source 104 in order to form the wide beam 101 after passing via the point of focus 106.

This arrangement of optical elements is obtained by first considering the source 104 to be located at the first focal point of an ellipsoid serving as a base for generating the reflector 102, the point of focus 106 being located at the second focal point of the ellipsoid.

Starting with such an arrangement of a reflector and its associated source, the entire module 100 is constructed with an eye to a symmetrical arrangement of the various reflectors. In this example, where the module 100 comprises two reflectors, this symmetry is obtained about a vertical plane 200 (FIG. 2) passing through the optical axis of the toric lens 108, which, in this embodiment, is located at the intersection of the vertical plane 200 and a horizontal plane passing through the source 104. The optical axis of the toric lens 108 is, for example, illustrated by the axis Oy in FIGS. 3 and 4.

According to this conception, the reflectors 102 and 102', the light sources 104 and 104', and the points of focus 106 and 106' are symmetric about the plane 200. In addition, as may be seen in FIG. 2, the segments 202 joining the source 104 and the point 106, and 202' joining the source 104' and the point 106' make an angle a to the median plane 200.

It will be noted that FIG. 2 shows the focal line 118 of the lens 108 which comprises, inter alia, the points of focus 106 and 106' of the reflectors 102 and 102'. Since the lens 108 is a toric lens, beams 101 and 101' are focused to infinity in the vertical direction, whereas, in the horizontal direction, they are spread, in order to allow them to fulfill their illuminating function.

Figure 3:
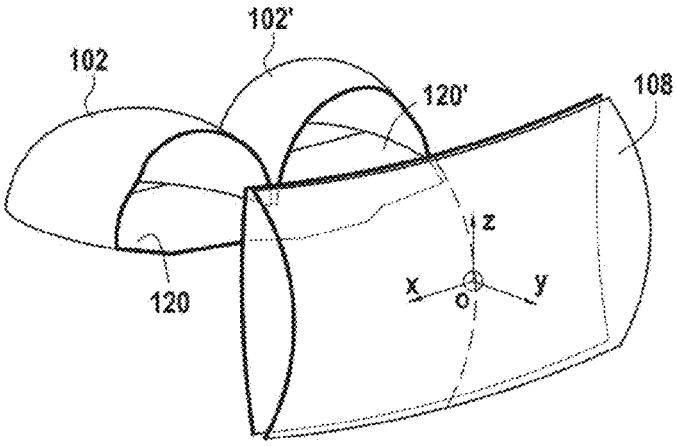
Figure 4:
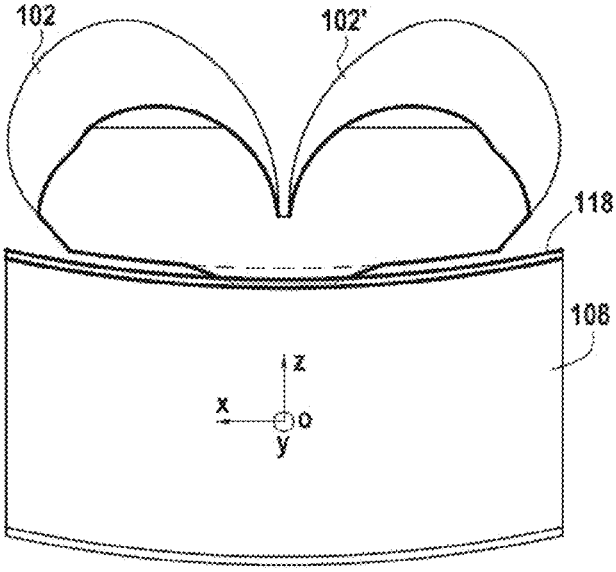

The reflectors 102 and 102' are associated with a flat substantially horizontal plate 120 as shown in FIGS. 3 and 4. The plane of this plate 120 preferably, but not necessarily, passes substantially through the centers of the light sources 104 and 104'. The reflectors 102 and 102' are located above the plate 120 and the upper face of the plate 120 is reflective in order to deflect the light rays coming from the reflectors 102 and 102'.

The reflective plate 120 is frequently called a "deflector" and it comprises a front end edge designed to form the cutoff in the illuminating beam, i.e. the upper limit above which there are no light rays. When the plate 120 is horizontal, the cutoff is horizontal and the zone illuminated by the beam coming from the reflectors 102 and 102' is located below a horizontal line.

FIGS. 3 and 4 show two perspective views of reflectors 102 and 102' obtained using the arrangements described above, produced in a coordinate system (O, x, y, z) where the axis Oy is the optical axis of the module.

In a nonlimiting numerical example, the toric lens 108 has a horizontal radius of curvature of 80 mm and its center has the coordinates (0, −30 mm, 0). The center of the toric lens 108 is defined by the center of curvature in the plane Oxy of the input and output faces of the lens 108. Such a lens possesses a focal line 118 coincident with the edge of the deflector (not shown), the distance between this focal line 118 and the input face of the lens 108 being a focal length T of 28.8 mm.

On the basis of these parameters and the coordinates of a light source (namely a light-emitting diode located at coordinates (20 mm; −14.715 mm; −0.376 mm)), the two second focal points of each reflector are determined such that the collectors are generated on the basis of an ellipsoid of revolution of focal point F=5.8 mm, the second cavity being generated by symmetry about the plane 200 of symmetry (plane Oyz in this example).

Figure 6:
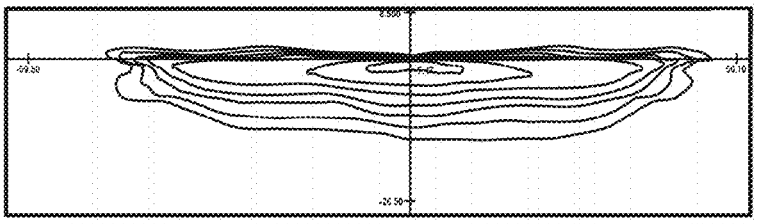
FIGS. 6 to 9 show isolux contour plots for various configurations of the module produced according to the invention.

Next, improvements are made especially with an eye to the fact that the deflector is simply an extension of the focal line in a direction opposite the optical direction, secondary modifications being made to the reflectors in order to improve the uniformity of the assembly, in order to obtain the intensity profile shown in FIG. 6.

It is also possible to make a correction to the deflector in order to improve the center of the beam. More precisely, the deflector is extended (by 4 mm in the +y direction in the examples in FIGS. 3 and 4) with a shape that follows the two increases in brightness at the center of the beam. This shape deflects images at the center of the beam above the cutoff, which images result from the association of two points of focus with two sources.

Figure 7:
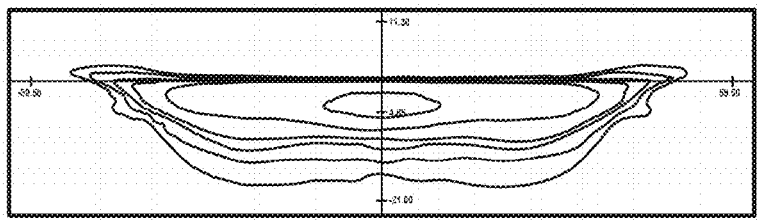
Figure 8:
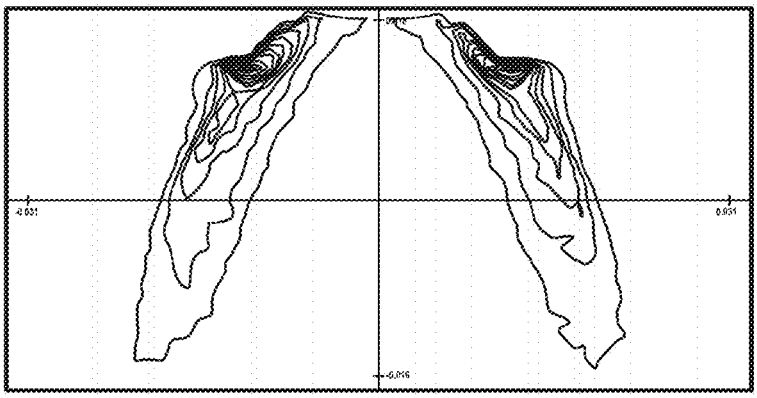

FIG. 7 shows the variation in the center of the beam whereas FIG. 8 shows the distribution of light over the surface of the deflector, this figure also highlighting the importance of the depth of the deflector (32 mm in the preceding example) if a maximal amount of flux is to be collected.

FIG. 8 shows a top view of the light concentration projected by the mirrors onto the deflector (the horizontal and vertical axes are scaled in units of millimeters). It may in particular be seen that brightness maxima are projected onto the edge of the deflector, but it may also be seen that a non-negligible amount of light strikes the deflector upstream of the edge.

Thus, the minimum depth needed to transmit more light rays to the deflector, in order to reflect them toward the lens, with the aim of increasing the luminous flux of the final beam 101, is determined. It is therefore possible to optimize this depth depending on the final light beam desired, i.e. depending on the regulations that this light beam must meet.

In a last step, corrections are made to the reflectors and uniformity is improved by directing attention to the end of the V shape of the beam.

This part of the beam results from the edges of the reflectors 102 and 102' (FIG. 3) which are modified to have a different focal point from the focal point of the ellipsoid that was used as a base for producing the reflectors, in order to correct the brightness increase by focusing slightly in front of the second focal point of the reflector.

Figure 9:
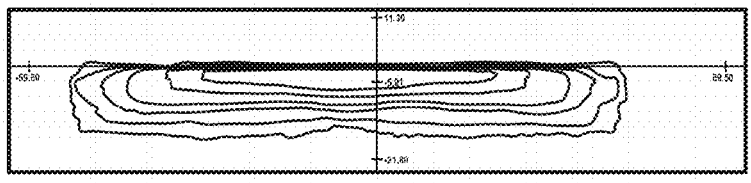
Figure 10:
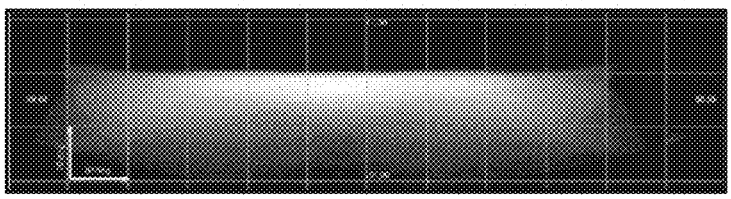
FIG. 10 shows a light beam emitted by a module produced according to the invention traced on a screen perpendicular to the optical axis of the module.

Next, a surface joining the two collector sections is introduced while maintaining the tangential continuity of the cavity as a whole, this making it possible to achieve the flux shown in FIGS. 9 and 10, which show a resultant flux of 276 lumen produced using two light-emitting diode sources having an optical power of 250 lumen, on account of the external cover that, in this case, attenuates the beam by 15%. Thus a particularly satisfactory final efficiency of 65% is obtained.

Figures 5A, 5B, 5C:
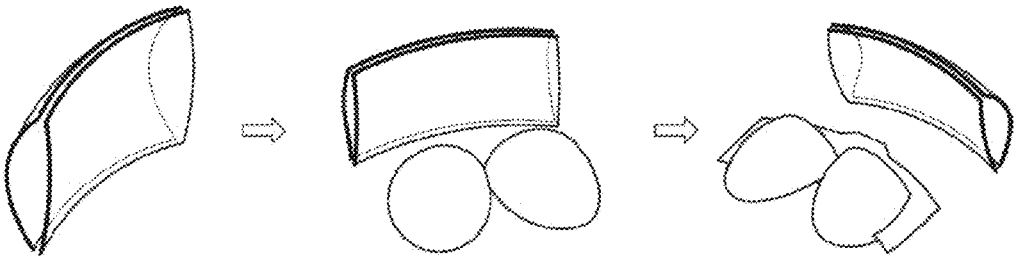
FIGS. 5A, 5B and 5C show, in perspective, various steps for producing a reflector according to the invention.

The present invention is open to many variants relating to the number of reflectors or to the position of one or more of the optical elements of a module. In summary, FIGS. 5A-5C illustrate the three main steps described for producing a module according to the invention, namely:

a first step of determining the focal line of a toric lens;

a second step of determining the basic structure of the reflectors based on an ellipsoid the focal points of which correspond, on the one hand, to the source of the light beams, and on the other hand, to the point of focus of these beams; and a third step of optimizing the overall beam formed by the sum of the various beams.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An illuminating module for a motor vehicle lamp able to form a wide light beam containing a cutoff, said illuminating module comprising:

an output lens; and a plurality of concave reflectors associated with a deflector having a reflective face intended to deflect light beams generated by light sources located in the concavities of said plurality of concave reflectors;

said output lens being a toric lens;

wherein said plurality of concave reflectors, said output lens and said light sources being arranged in order to make said light beams generated by said light sources converge on points of focus before said light beams are transmitted through said output lens;

wherein said plurality of concave reflectors oriented toward each other so that their respective axes intersect so that at least some light beams from said plurality of concave reflectors crosses before said light beams are transmitted through said output lens.

2. The illuminating module according to claim 1, wherein said points of focus are located on a focal line of said output lens.

3. The illuminating module according to claim 1, wherein said deflector follows, partially or totally, a focal line of said output lens.

4. The illuminating module according to claim 1, wherein said plurality of concave reflectors are based on an ellipsoid shape having two focal points, said light source of one of said plurality of concave reflectors being located at a first focal point of said ellipsoid shape and said point of focus being located at a second focal point of said ellipsoid shape.

5. The illuminating module according to claim 4, wherein an axis of one of said plurality of concave reflectors, passing through said first and second focal points of said ellipsoid shape on which said axis is based, forms a non-zero angle with an optical axis (Oy) of said output lens.

6. The illuminating module according to claim 1, wherein said illuminating module has a plane of symmetry.

7. The illuminating module according to claim 1, wherein a total lateral aperture of an optical beam from the illuminating module lies between 40 degrees and 100 degrees.

8. A method for manufacturing an illuminating module for a motor vehicle lamp able to form a wide light beam containing a cutoff, said illuminating module is equipped with optical elements comprising an output lens and a plurality of concave reflectors associated with a deflector having a reflective face intended to deflect light beams generated by light sources located in the concavities of said plurality of concave reflectors, wherein said method comprises a step of arranging these optical elements in order to make said light beams generated by said light sources converge on points of focus before said light beams are transmitted through said output lens, in accordance with the illuminating module as claimed claim 1.

9. The illuminating module according to claim 2, wherein said deflector follows, partially or totally, said focal line of said output lens.

10. The illuminating module according to claim 2, wherein said plurality of concave reflectors are based on an ellipsoid shape having two focal points, said light source of one of said plurality of concave reflectors being located at a first focal point of said ellipsoid shape and said point of focus being located at a second focal point of said ellipsoid shape.

11. The illuminating module according to claim 3, wherein said plurality of concave reflectors are based on an ellipsoid shape having two focal points, said light source of one of said plurality of concave reflectors being located at a first focal point of said ellipsoid shape and said point of focus being located at a second focal point of said ellipsoid shape.

12. The illuminating module according to claim 2, wherein said illuminating module has a plane of symmetry.

13. The illuminating module according to claim 3, wherein said illuminating module has a plane of symmetry.

14. The illuminating module according to claim 4, wherein said illuminating module has a plane of symmetry.

15. The illuminating module according to claim 5, wherein said illuminating module has a plane of symmetry.

16. The illuminating module according to claim 2, wherein a total lateral aperture of an optical beam from the illuminating module lies between 40 degrees and 100 degrees.

17. The illuminating module according to claim 3, wherein a total lateral aperture of an optical beam from the illuminating module lies between 40 degrees and 100 degrees.

18. The illuminating module according to claim 4, wherein a total lateral aperture of an optical beam from the illuminating module lies between 40 degrees and 100 degrees.

19. The illuminating module according to claim 5, wherein a total lateral aperture of an optical beam from the illuminating module lies between 40 degrees and 100 degrees.

20. The illuminating module according to claim 6, wherein a total lateral aperture of an optical beam from the illuminating module lies between 40 degrees and 100 degrees.

21. The illuminating module according to claim 1, wherein said axes of said plurality of concave reflectors intersect upstream of said output lens.

22. The illuminating module according to claim 1, wherein said plurality of concave reflectors comprise a first reflector and a second reflector.

23. The illuminating module according to claim 1, wherein said light beams from said plurality of concave reflectors crosses said output lens at the same place.

* * * * *